US005407403A

United States Patent [19]

Coleman

[11] Patent Number: 5,407,403

[45] Date of Patent: Apr. 18, 1995

[54] FORCED REPETITION ASSIST DEVICE

[76] Inventor: Vernon Coleman, 4096 Fairway Ave., Oakland, Calif. 94605

[21] Appl. No.: 118,612

[22] Filed: Sep. 10, 1993

[51] Int. Cl.[6] ..... A63B 21/072

[52] U.S. Cl. ..... 482/6; 482/104

[58] Field of Search ..... 482/97–104, 482/5–7

[56] References Cited

U.S. PATENT DOCUMENTS

| | | | |
|---|---|---|---|
| 3,998,100 | 12/1976 | Pizatella . | |
| 4,249,726 | 2/1981 | Faust | 482/104 X |
| 4,253,662 | 3/1987 | Popolak | 482/104 |
| 4,709,922 | 12/1987 | Slade, Jr. et al. | 482/104 |
| 4,746,113 | 5/1988 | Kissel | 482/98 |
| 4,765,610 | 8/1988 | Sidwell . | |
| 4,921,244 | 5/1990 | Berroth . | |
| 4,949,959 | 8/1990 | Stevens . | |
| 4,973,050 | 11/1990 | Santoro et al. | 482/102 |
| 4,998,721 | 3/1991 | Anders . | |
| 4,998,723 | 3/1991 | Santoro | 482/104 |
| 5,048,826 | 9/1991 | Ryan . | |
| 5,190,510 | 3/1993 | Goodger . | |

*Primary Examiner*—Richard J. Apley
*Assistant Examiner*—John Mulcahy

[57] ABSTRACT

A device which promotes concentric muscle development by automatically rendering assistance to a weightlifter who is experiencing muscle fatigue. The device contains a motor driven cable which can be connected to either a barbell or dumbbells. The device does not affect the weightlifter when not activated, and is activated when the weightlifter lifts the weight slower than a pre-programmed velocity limit. In addition the device functions as a safety apparatus in that it slows the downward travel of a weight which has exceeded a pre-programmed velocity limit.

6 Claims, 2 Drawing Sheets

FORCED REPETITION ASSIST DEVICE

BACKGROUND OF THE INVENTION

1. Field of the Invention

The invention relates to weight lifting, particularly to a device for allowing a range of weight training movements utilizing barbells and dumbbells to be completed even after the weightlifter has reached severe muscle fatigue.

2. Discussion of Prior Art

It is well known that increasing the stress on a muscle being trained leads to increased muscle growth. To maximize a particular muscle's development one must contract the muscles over its full range of movement until the muscle's concentric force is dissipated. At this point a training partner is necessary to assist the weightlifter in performing several more repetitions in order to increase stress on the muscle and hence facilitate enhanced growth. The repetitions of the movement that are assisted by the training partner are called "forced repetitions".

When the weightlifter is in a training cycle that requires forced repetitions, he or she will need a training partner throughout the total training session. A session may be two, three, or more hours in length. Thus the training partner must either be solely dedicated to assisting the weightlifter, or must be able to alternate between his or her personal training routine and assisting the weightlifter with forced repetitions.

For most weightlifters the problem has been in insuring that a training partner would be available for the weightlifter on a continual basis, thereby insuring maximum development in a shorter period of time.

Heretofore, the operational design of weightlifting assistance devices which have been conceived have not taken advantage of the use of both barbells and dumbbells. Barbells and dumbbells are commonly referred to as free weights because of their unrestricted movement. Experienced weightlifters prefer free weights because they allow the user to experience muscle contraction through a full range of motion that is natural to the individual. In addition the balancing of the free weight brings into play other collateral muscles that would not be involved if the weight were being guided by machine action. Using the full range of motion and employing collateral muscles allows the weightlifter to develop muscle mass at an accelerated rate. In many cases dumbbells are used in conjunction with barbells because they allow the user to employ a greater range of motion than do barbells.

Earlier assistance devices which do not employ free weights have been found in three patents.

U.S. Pat. No. 3,998,100, dated Dec. 21, 1976 to Robert F. Pizatella et al. details an "Exercise Process and Apparatus" machine that automatically varies its resistance such that a user can move a simulated weight faster than a predetermined minimum velocity.

U.S. Pat. No. 4,765,618, dated Aug. 23, 1988 to David A. Sidwell details an "Accessory for Weight Lifting Equipment" which is an add on device for conventional stack weight machines or an apparatus that guides the movement of a barbell. Sidwell does not accommodate unrestricted free weight movement of the weight being lifted and in addition requires that a switch be manually manipulated for assistance in lifting or lowering the weight. Such manual switch operation requires the weightlifter to shift his or her hand, leg, or foot position.

This often causes a break in concentration which adversely effects the lifting effort.

An "Apparatus for Positive Muscle Training is detailed in U.S. Pat. No. 4,921,244, dated May 1, 1990 to Kurt Berroth. Berroth also details an apparatus that may be added to existing stack weight machines. The apparatus assists the user in lifting the weight if the speed of the machine's weight falls below a predetermined rate. Berroth's device ceases its assistance to the user if the speed of the machine's weight falls below a preset lower threshold. Therefore the machine ceases operation just when the free weight user needs assistance. Furthermore the machine does not include the ability to recognize the apex of the movement being performed, hence the machine does not know when to stop the upward movement of a free weight. These factors render it ineffective for free weight applications.

Assist devices for barbells have been discovered in four patents. U.S. Pat. No. 4,949,959, dated Aug. 2, 1990 to William E. Stevens details a "Barbell Assist Device" which lifts and lowers barbells by use of a foot kick plate operated motor; U.S. Pat. No. 4,998,721, dated Mar. 12, 1991 to Douglas H. Anders et al. details a "Weightlifter's Exercising Apparatus" which also raises a weight by kick plate operated motor and lowers the weight by disconnecting the barbell from the motor; and U.S. Pat. No. 5,190,510, dated Mar. 2, 1993 to John Goodger details a "Bench Press Apparatus" which raises and lowers a barbell with a knee activated switch.

Because of their cable architectures all three of these barbell based inventions will not adequately support dumbbell press movements. Correctly executed dumbbell presses require that the weights be brought together at the apex of the movement. The inventions of Anders and Stevens will act to keep dumbbells separated when giving assistance. The invention of Goodger uses a single point of attachment to the weight being lifted, and therefore will not adequately support the use of two dumbbells. In addition these three inventions have been optimized only for the barbell bench press. The manual operation of the motor switch would become awkward or even dangerous for a standing exercise such as the squat because any shift in balance to operate the switch could cause the weightlifter to topple over.

A fourth barbell device is detailed in U.S. Pat. No. 5,048,826, dated Sep. 17, 1991 to William C. Ryan, entitled "Safety Apparatus for Use With Barbell Assembly". In its stated form the device does not find the apex of the movement but rather pulls the weight back to the height at which it was initially at rest. The device detects and terminates an erratic descent of a weight or the total lack of ascent of a weight, as opposed to compensating for growing fatigue when the weightlifter is lifting the weight. These factors render the device unsuitable for barbell forced repetition applications. In addition the dual cable architecture makes it unsuitable for general dumbbell use, as explained in previous examples.

OBJECTIVES AND ADVANTAGES OF THE INVENTION

Accordingly one object of the instant invention is to provide a consistent and dependable mechanical training partner on demand. Furthermore the mechanical training partner is capable of assisting in a wide variety of exercise movements involving barbells and dumbbells. The training partner is transparent to the user when assistance is not required. The training partner simulates a human training partner in that it will automatically give assistance to help lift the weight or weights if the weightlifter becomes fatigued. This assistance will continue for as many repetitions as the weightlifter can participate or wills to participate. The training partner adjusts to the weightlifter's individual preference regarding the level of muscle fatigue at which assistance is initiated, as well as the length of travel over which the assistance is given.

Further objects and advantages will become apparent from a consideration of the ensuing description and drawings.

SUMMARY OF THE INVENTION

In accordance with a preferred embodiment of the instant invention, a vertical column is topped by a horizontal protruding arm. Extending downward from the protruding arm is a single cable. The end of the downward extending cable is in turn attached to a pulley. A second cable is centered on the pulley. The ends of the second cable are attached to either side of a barbell assembly. In the case of dumbbells, the ends of the second cable are in turn attached to small pulleys. A third and fourth set of cables are centered on these two pulleys respectively. The ends of the third and forth cables attach to either end of two dumbbells. The opposite end of the cable that extends from the top horizontal arm is connected by various mechanical means to a counterweight. The counterweight keeps the cable taut.

Furthermore a mechanical means which connect the cable to the counterweight is selectively connected to an electric motor. The electric motor is turned on and off by various electronic devices which sense and calculate the position and velocity of the cable. If the weight lifter has not reached the apex of his or her movement and the velocity of the upward movement of the barbell or dumbbell is below a predetermined limit, then the motor is activated and the barbell or dumbbell is pulled up to a predetermined height. Upon reaching the predetermined height the electric motor is turned off and mechanically disconnected from the cable. The weightlifter is then free to lower the weight back to its lower starting position.

If in the process of lowering the barbell or dumbbell the weight lifter exceeds a predetermined downward velocity, the cable is connected to the motor which is in an off state. The movement of the cable causes the motor to supply a resisting force, which slows the velocity of the weight.

In addition the weightlifter is informed as to the amount of assistance given at the termination of the lifting repetitions.

DESCRIPTION OF THE DEVICE-FIG. 1

Figure 1:
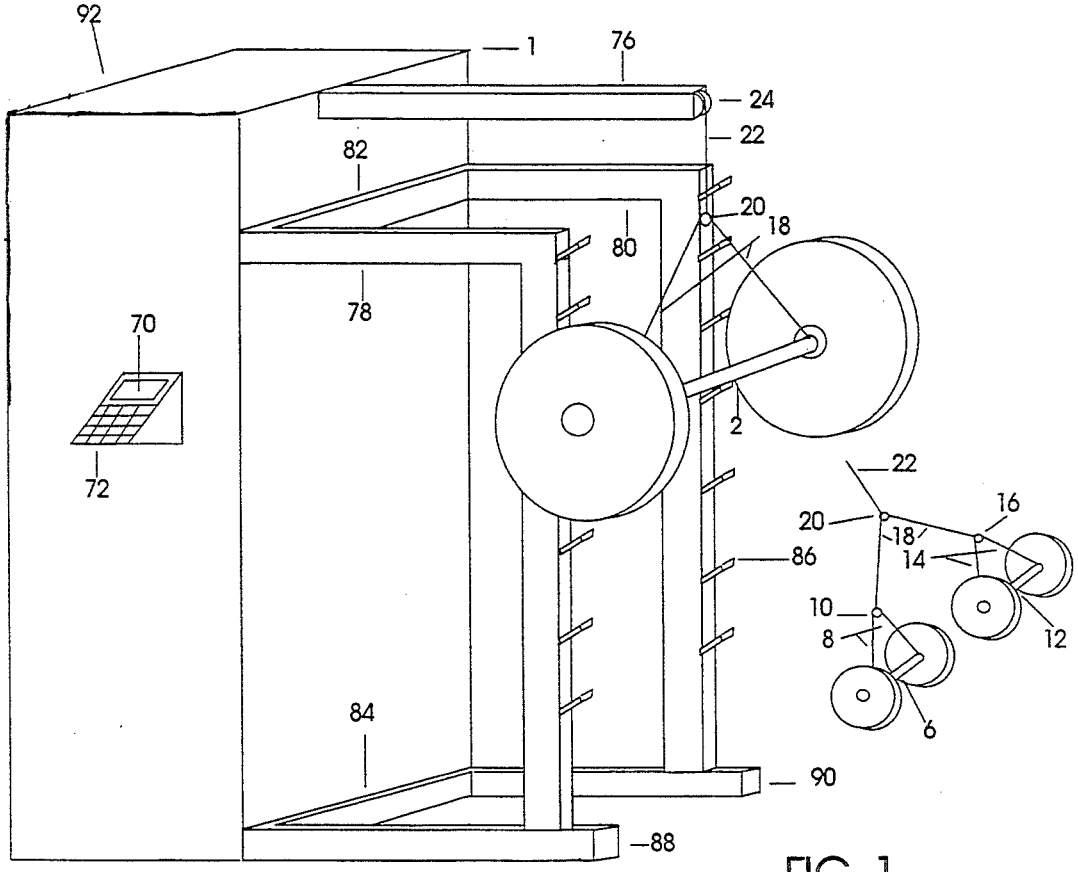
FIG. 1 is a external perspective view of a representative embodiment of the forced repetition assist device according to the invention.
Figure 2:
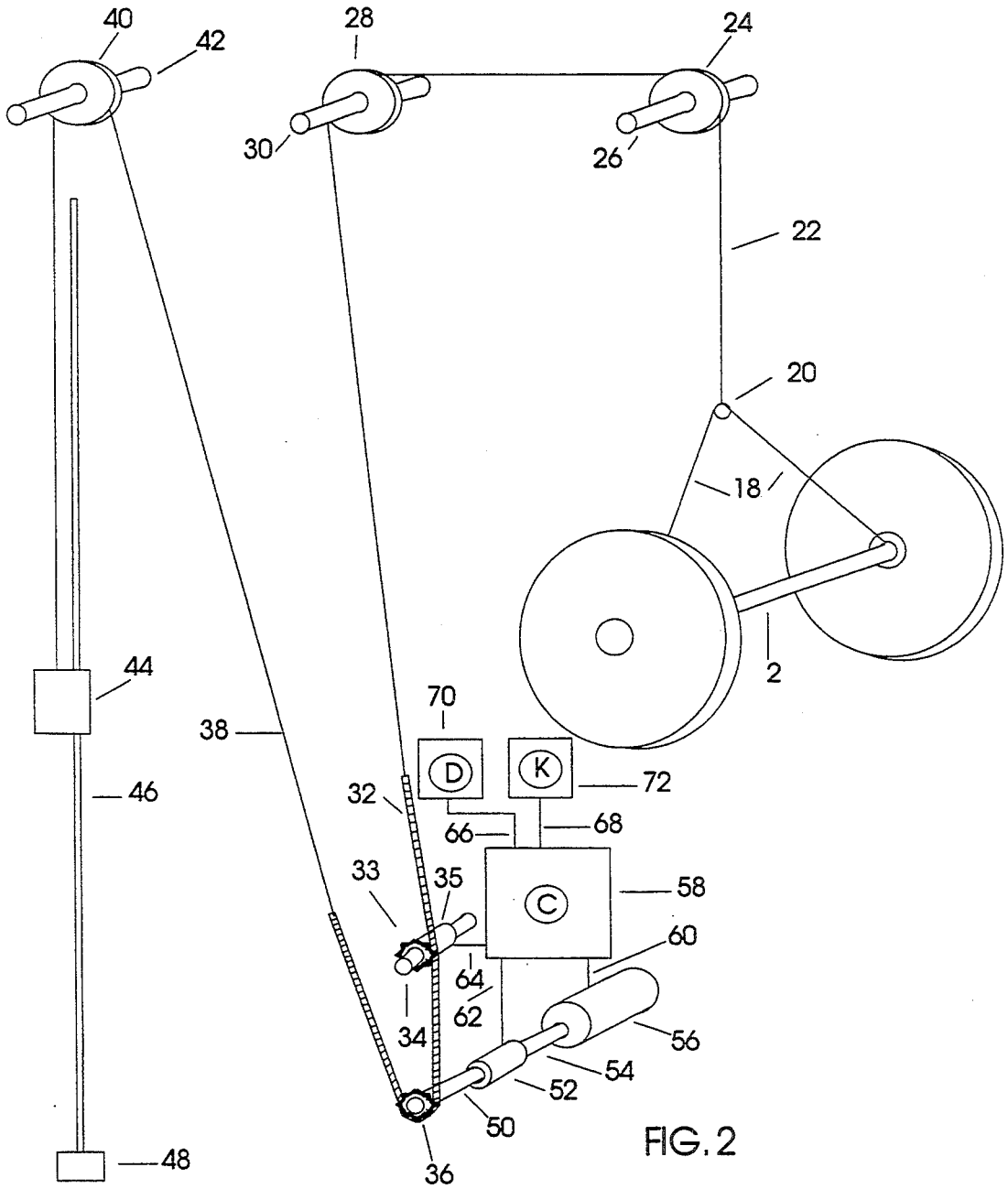
FIG. 2 is a schematic depiction of an external barbell assembly connected to internal electrical, mechanical, and electronic control components.

A basic embodiment of the assist device is illustrated in FIGS. 1 and 2 and generally indicated at in FIG. 1. The apparatus is comprised of a vertical housing 92 which also serves as a buttress and contains various mechanical, electronic, and electrical components which, when used in concert, detect and if necessary alter the velocity of cable segment 22. Cable segment 22 is in turn connected to a pulley 20. Cable 18 is centered on pulley 20, with the ends of the cable attached to the barbell assembly. Alteratively for dumbbell connection the ends of cable 18 are connected to pulleys 10 and 16. Cables 8 and 14 are respectively centered on pulleys 10 and 16. The ends of cables 8 and 14 are attached to dumbbells 6 and 12, respectively. Cable segment 22 extends downward from a sheave 24 which is attached to an extension arm 76. Vertical unit 92 is supported in an upright position by foot extensions 88 and 90 and cross member 84. Apparatus 1 includes generally "L" shaped legs 78 and 80 which have a plurality of support arms 86 on which the barbell or dumbbells may be rested. The "L" shaped arms are braced by cross member 82. Operational parameters for apparatus 1 are introduced by a keypad 72. Operational parameters and weightlifter performance results may be viewed on a liquid crystal device output screen 70.

OPERATION OF THE DEVICE-FIG. 2

The internal operation of the device is detailed in FIG. 2. In general a weight (in this case a barbell) is attached by support cable 18 to cable segment 22. Cable segment 22 is guided by cable sheave 24 on shaft 26 and sheave 28 on shaft 30. Cable segment 22 is connected to roller chain 32. The roller chain drives a cable position assembly comprised of sprocket 33 shaft 34 and shaft encoder 35. The roller chain is selectively moved by a cable governor assembly. The governor assembly is comprised of a sprocket 36, an electric clutch 52, and a variable speed constant torque electric motor 56 connected to shafts 50 and 54. Roller chain 32 is joined to a second cable segment 38 which is guided over a cable sheave 40 on shaft 42 and terminated by an internal counterweight 44. The internal counterweight serves to keep the cable and roller chain segments taut and seated on their respective sheaves and sprockets. The counterweight is guided by guide shaft 46 which is secured by base clamp 48.

The movement of the barbell and hence that of the of cable and roller chain, sprocket, and shaft is detected by a shaft encoder 35. Shaft encoder information is passed over connection 64 to the electronic general control unit 58 represented by a box containing the encircled "C". The general control unit comprises a general purpose microprocessor, such as an Intel 80286 programmable by conventional programming techniques, and a motor controller such as a Lesson 174311.

The device becomes passive if the rate of ascent of the barbell is in excess of a user programmable limit velocity. The weightlifter enters this velocity into the control unit 58 by using keypad 72 which is represented by a box containing an encircled "K". The information from the keypad is passed through connection 68 to the control unit 58. Control unit 58 compares the shaft rotation information from the shaft encoder with the limit from the keypad. If the limit is exceeded, then the control unit disengages the clutch by way of line 62, a and turns off motor 56 by way of line 60. The weightlifter experiences only the additional small lifting force supplied by the internal counterweight 44 as it pulls on the cable and chain segments. If the upward velocity of the weight falls below the programmed velocity then the motor and clutch are activated by the control unit. At this time control unit 58 makes sprocket 36 rotate in a clockwise direction thereby causing the roller chain and cable segment to decrease the gravitational pull of the barbell on the weightlifter.

The motor and clutch will remain engaged until the upward movement of the barbell exceeds the programmed velocity, or the barbell reaches a predetermined height which represents the apex of the particular movement being performed. (The apex can be determined by finding at what distance the shaft encoder switches direction from clockwise to counterclockwise.)

If the velocity or apex limit is reached then the control unit causes the motor to turn off and the clutch to disengage, thereby allowing the user to either continue to move the full gravitational weight (minus the counterweight) of the barbell upward, or lower the barbell to its initial starting position.

If the weightlifter lowers the barbell in excess of a predetermined velocity, indicating loss of muscular control, the general control unit engages the clutch. The now counterclockwise movement of sprocket 36 causes the motor in its off state to function as a generator that produces current and an opposing clockwise torque. The opposing torque initiates a braking action on the rotation of sprocket 36, and thus slows the descent of the barbell.

What has been described is a highly versatile forced repetition device which can be used in conjunction with barbells and dumbbells to give the weightlifter the advantage of free weight training, without the necessity of a human training partner.

The user of the assist device can attain speeded muscular development by performing the wide range of exercise movements afforded by barbells and dumbbells, in conjunction with the intensity provided by forced repetitions. The user is no longer restricted to employing forced repetitions only if he or she can obtain prolonged human assistance. The assist device is automatically activated, thus the user does not have to break his or her concentration to locate an actuator. The assist device provides a progress report for the user by displaying information on assistance rendered.

Although the preferred embodiment of the invention has been described, it should be understood by those skilled in the art that various modification may be made without departing from the spirt of the invention. Examples of possible modifications include the addition of a means to increase torque between motor 56 and clutch 52 or between clutch 52 and drive sprocket 36. Increasing torque will allow greater loads to be lifted by the device, a less powerful motor 56 to be employed, or a combination of the two benefits. The means to increase the torque could be gears or chain and sprockets.

Another modification could be the addition of real-time audio feedback initiated by control unit 58. The feedback would give the user an instant report on the assistance being rendered by the device, and thus could be used for motivation.

Accordingly the scope of the invention should be determined by the appended claims and their legal equivalents, and not the examples given.

What is claimed is:

1. A forced repetition assist device comprising:

(a) first and second dumbbells;

(b) a first elongate member connected to opposite ends of said first dumbbell;

(c) a second elongate member connected to opposite ends of said second dumbbell;

(d) a first elongate flexible member, each end of said first elongate flexible member connected to said first and second elongate member respectively;

(e) a second elongate flexible member, one end of said second elongate flexible member connected to said first elongate flexible member;

(f) a support means for supporting said second elongate flexible member operatively above a user;

(g) a velocity sensing means for sensing the speed and direction of longitudinal travel of said second elongate flexible member;

(h) a governing means couplable to said second elongate flexible member for selectively retracting said second elongate flexible member so as to raise said first and second dumbbells;

(i) a control means for directing said governing means to selectively retract said second elongate flexible member based on input from said velocity sensing means.

2. The assist device of claim 1 wherein said velocity sensing means comprises a shaft encoder.

3. The assist device of claim 1 wherein said cable governor means includes an electric motor and electric clutch.

4. The assist device of claim 1 wherein said control means includes a general purpose microprocessor.

5. A forced repetition assist device comprising: an elongate flexible member;

a first pulley connected to one end of said elongate flexible member;

a first cable operatively connected to said first pulley;

a second and a third pulley respectively connected to the respective ends of said first cable;

a second and a third cable respectively operatively connected to said second pulley and said third pulley;

first and second dumbbells respectively connected to said second cable and said third cable;

support means for supporting said elongate flexible member operatively above a user;

velocity sensing means for sensing the speed and direction of longitudinal travel of said elongate flexible member;

governing means couplable to said elongate flexible member for selectively retracting said elongate flexible member so as to raise said dumbbells;

control means for directing said governing means to selectively retract said elongate flexible member based on input from said velocity sensing means.

6. A forced repetition assist device comprising:

an elongate flexible member;

a first pulley connected to one end of said elongate flexible member;

a first cable operatively connected to said first pulley;

a second and a third cable respectively connected to opposite ends of said first cable;

first and second dumbbells respectively connected to said second cable and said third cable;

support means for supporting said elongate flexible member operatively above a user;

velocity sensing means for sensing the speed and direction of longitudinal travel of said elongate flexible member;

governing means couplable to said elongate flexible member for selectively retracting said elongate flexible member so as to raise said dumbbells;

control means for directing said governing means to selectively retract said elongate flexible member based on input from said velocity sensing means.

* * * * *